US008459531B2

(12) United States Patent
D'Amato

(10) Patent No.: US 8,459,531 B2
(45) Date of Patent: Jun. 11, 2013

(54) CONTAINER AND BLANK FOR THE PRODUCTION THEREOF

(75) Inventor: Gianfranco D'Amato, Arzano Napoli (IT)

(73) Assignee: Seda S.p.A., Arzano Napoli (IT)

( * ) Notice: Subject to any disclaimer, the term of this patent is extended or adjusted under 35 U.S.C. 154(b) by 690 days.

(21) Appl. No.: 12/067,193

(22) PCT Filed: Sep. 14, 2006

(86) PCT No.: PCT/EP2006/008983
§ 371 (c)(1), (2), (4) Date: Sep. 19, 2008

(87) PCT Pub. No.: WO2007/033794
PCT Pub. Date: Mar. 29, 2007

(65) Prior Publication Data

US 2009/0014507 A1 Jan. 15, 2009

(30) Foreign Application Priority Data

Sep. 19, 2005 (DE) ..... 20 2005 014 738 U

(51) Int. Cl.
*B65D 5/42* (2006.01)
*B65D 5/20* (2006.01)

(52) U.S. Cl.
USPC ..... 229/109; 229/110; 229/149

(58) Field of Classification Search
USPC ..... 229/136, 131, 185.1, 157, 109, 110, 229/101.1, 902; 220/62.1
See application file for complete search history.

(56) References Cited

U.S. PATENT DOCUMENTS 23,200 A 3/1859 Stimpson
1,549,417 A 8/1925 Hendrich (Continued)

FOREIGN PATENT DOCUMENTS

CA 742539 9/1966
CA 837922 3/1970

(Continued)

OTHER PUBLICATIONS

International Search Report mailed Nov. 17, 2006 in PCT/EP2006/008984.

(Continued)

*Primary Examiner* — Nathan J Newhouse
*Assistant Examiner* — Christopher Demeree
(74) *Attorney, Agent, or Firm* — Fish & Richardson P.C.

(57) ABSTRACT

A container (1) for storing and removing food comprises a first and a second container half (2, 3) which are connected to each other by means of a pivotable connection in order to pivot between an open position (4) and a closed position (5). To improve such a container to the effect that it is also suited for the consumption of the food and can be simultaneously produced more stably and economically while it is easy to assemble, each container half (2, 3) comprises an upper and lower polygonal container wall (7, 8; 9, 10), when seen from above, and a lateral wall (11, 12) which connects the walls at a distance in relation to each other, wherein the pivotable connection is embodied by a pivotable line embodied between facing first ends (13, 14) of the lateral walls (11, 12), and the second ends (15, 16) of the lateral walls (11, 12) are in the closed position (5) detachably connected to each other, wherein the pivotable axis (17) associated to the pivotable line (6) extends essentially perpendicular to the upper and lower container walls (7, 9; 8, 10). Moreover, a single-pieced blank (60) is provided for producing such a container (1).

34 Claims, 4 Drawing Sheets

U.S. PATENT DOCUMENTS 1,814,671 A 7/1931 Dufour
1,899,772 A 2/1933 Richardson
2,288,602 A 5/1939 Benton
2,266,828 A 12/1941 Sykes
2,342,623 A * 2/1944 Aquino ..... 229/110
2,493,633 A 1/1950 Mart
2,591,578 A 4/1952 McNealy et al.
2,661,889 A 12/1953 Phinney
2,692,722 A 10/1954 Johnson
2,725,733 A 12/1955 Howlett
2,828,903 A 4/1958 Adkins
2,832,465 A 4/1958 Vuillemenot
2,847,117 A 8/1958 Vuillemenot
2,863,585 A 12/1958 Meshberg
2,899,098 A 8/1959 Gits
2,982,465 A 5/1961 Fallert
3,079,027 A 2/1963 Edwards
3,082,900 A 3/1963 Goodman
3,124,293 A 3/1964 Transport
RE25,618 E 7/1964 Goodman
3,225,954 A 12/1965 Herrick et al.
3,343,660 A 9/1967 Bailey
3,355,046 A 11/1967 Jolly
3,372,830 A 3/1968 Edwards
3,401,862 A 9/1968 Wanderer
3,428,214 A 2/1969 Leon
3,456,860 A 7/1969 Janninck
3,463,379 A * 8/1969 Dlugopolski ..... 229/117.24
3,471,075 A 10/1969 Wolf
3,541,599 A 11/1970 Ramshaw et al.
3,580,468 A 5/1971 McDevitt
3,765,559 A 10/1973 Sauey et al.
3,766,975 A 10/1973 Todd
D231,068 S 4/1974 Douglas
3,850,361 A 11/1974 Day et al.
3,908,523 A 9/1975 Shikaya
3,927,766 A 12/1975 Day
4,018,904 A 4/1977 Muraoka
4,040,537 A 8/1977 Edwards
4,089,358 A 5/1978 Korson
4,124,120 A 11/1978 Day
4,189,054 A * 2/1980 Liu et al. ..... 220/4.23
4,261,501 A 4/1981 Watkins et al.
4,267,959 A 5/1981 Gilbert
4,360,147 A 11/1982 Brauner
4,368,818 A 1/1983 Day et al.
4,560,075 A 12/1985 Lu
4,706,873 A 11/1987 Schult
4,763,832 A 8/1988 Forbes, Jr.
4,771,911 A 9/1988 Morony et al.
4,773,622 A * 9/1988 Herlin ..... 248/174
4,789,073 A 12/1988 Fine
4,844,330 A 7/1989 Roosa et al.
4,850,496 A 7/1989 Rudell et al.
4,993,580 A 2/1991 Smith
5,076,463 A 12/1991 McGraw
5,092,485 A 3/1992 Lee
5,135,132 A 8/1992 Potochnik
5,145,107 A 9/1992 Silver et al.
5,188,284 A 2/1993 Eisman
5,205,476 A 4/1993 Sorenson
5,226,585 A 7/1993 Varano
5,363,982 A 11/1994 Sadlier
5,364,018 A * 11/1994 Carlsson ..... 229/120.17
5,460,323 A 10/1995 Titus
5,520,324 A 5/1996 Cai
5,524,817 A 6/1996 Meier et al.
5,542,599 A 8/1996 Sobol
5,547,124 A 8/1996 Mueller
5,551,592 A 9/1996 Barton et al.
5,553,735 A 9/1996 Kimura
5,553,772 A 9/1996 Jensen
5,573,141 A 11/1996 Chen
5,593,053 A 1/1997 Kaufman et al.
5,603,450 A 2/1997 Whitnell
5,628,453 A 5/1997 MacLaughlin
5,660,326 A 8/1997 Varano et al.
5,674,546 A 10/1997 Barnes et al.
5,678,725 A 10/1997 Yamada et al.
5,685,480 A 11/1997 Choi
5,697,550 A 12/1997 Varano et al.
5,713,512 A 2/1998 Barrett
5,752,653 A 5/1998 Razzaghi
RE35,830 E 6/1998 Sadlier
5,769,262 A 6/1998 Yamada et al.
5,769,311 A 6/1998 Morita et al.
5,772,111 A 6/1998 Kirsch
5,788,145 A 8/1998 Grahahm et al.
5,820,016 A 10/1998 Stropkay
5,826,781 A 10/1998 Jensen
5,839,599 A 11/1998 Lin
5,839,653 A 11/1998 Zadravetz
5,875,956 A * 3/1999 Benarrouch ..... 229/110
5,894,948 A 4/1999 Yeh
5,918,761 A 7/1999 Wissinger
5,950,917 A 9/1999 Smith
5,964,400 A 10/1999 Varano et al.
6,050,443 A 4/2000 Tung
6,065,632 A 5/2000 Moore, Jr.
6,076,699 A 6/2000 Seager et al.
6,085,970 A 7/2000 Sadlier
6,109,518 A 8/2000 Mueller et al.
6,116,503 A 9/2000 Varano
6,126,584 A 10/2000 Zadravetz
6,161,720 A 12/2000 Castle
6,193,098 B1 2/2001 Mochizuki et al.
6,196,454 B1 3/2001 Sadlier
6,224,954 B1 5/2001 Mitchell et al.
6,237,845 B1 5/2001 Hashimoto et al.
6,253,995 B1 7/2001 Blok et al.
6,257,485 B1 7/2001 Sadlier et al.
6,260,756 B1 7/2001 Mochizuki et al.
6,283,364 B1 9/2001 Gray, Sr.
6,332,538 B1 12/2001 Pritchard et al.
6,343,735 B1 2/2002 Cai
6,367,652 B1 4/2002 Toida et al.
6,375,066 B1 * 4/2002 Ritter ..... 229/101.2
6,378,766 B2 4/2002 Sadlier
6,382,449 B1 5/2002 Kazmierski et al.
6,419,108 B1 7/2002 Toida et al.
6,422,456 B1 7/2002 Sadlier
6,598,786 B1 7/2003 Guo
6,749,913 B2 6/2004 Watanabe et al.
6,811,843 B2 11/2004 DeBraal et al.
6,852,381 B2 2/2005 Debraal et al.
6,863,212 B2 3/2005 Stone et al.
6,908,651 B2 6/2005 Watanabe et al.
6,921,179 B2 7/2005 Diak Ghanem
6,926,197 B2 8/2005 Hed et al.
6,989,198 B2 1/2006 Masuda et al.
7,100,770 B2 9/2006 D'Amato
7,172,086 B2 2/2007 McKendry et al.
7,195,805 B2 3/2007 Breining et al.
D546,625 S 7/2007 Gluck
D547,122 S 7/2007 Gluck
D550,033 S 9/2007 Bodum
D550,034 S 9/2007 Bodum
D551,502 S 9/2007 Bodum
D553,437 S 10/2007 Bodum
D553,439 S 10/2007 Bodum
D553,440 S 10/2007 Bodum
D553,442 S 10/2007 Bodum
D553,909 S 10/2007 Bodum
D553,910 S 10/2007 Bodum
D553,911 S 10/2007 Bodum
7,281,650 B1 10/2007 Milan
D557,561 S 12/2007 Flowers et al.
D557,563 S 12/2007 Bodum
D557,564 S 12/2007 Bodum
7,306,113 B2 12/2007 El-Saden et al.
D562,075 S 2/2008 Mehta
D563,172 S 3/2008 Bodum
D577,260 S 9/2008 Bodum
7,451,910 B2 11/2008 Frost et al.
7,451,911 B2 11/2008 Stepanek, Jr.
D581,738 S 12/2008 Bodum
D581,739 S 12/2008 Bodum

| | | | |
|---|---|---|---|
| 7,458,504 | B2 | 12/2008 | Robertson et al. |
| 7,481,356 | B2 | 1/2009 | Stahlecker |
| 7,536,767 | B2 | 5/2009 | Hollis et al. |
| D594,277 | S | 6/2009 | Snell |
| D595,090 | S | 6/2009 | Benson |
| 7,552,841 | B2 | 6/2009 | Hollis et al. |
| D597,791 | S | 8/2009 | Lion et al. |
| D597,792 | S | 8/2009 | Lion et al. |
| 7,597,246 | B2 | 10/2009 | Stepanek, Jr. |
| 7,631,781 | B2 | 12/2009 | Chen |
| 7,677,435 | B2 | 3/2010 | Stahlecker |
| 7,694,843 | B2 | 4/2010 | Hollis et al. |
| 7,699,216 | B2 | 4/2010 | Smith et al. |
| 7,717,325 | B2 | 5/2010 | Puls et al. |
| 2001/0013537 | A1 | 8/2001 | Sadlier |
| 2002/0043555 | A1 | 4/2002 | Mader |
| 2002/0148832 | A1 | 10/2002 | Breining et al. |
| 2002/0172818 | A1 | 11/2002 | DeBraal et al. |
| 2003/0029876 | A1 | 2/2003 | Giraud |
| 2003/0226882 | A1 | 12/2003 | Porchia et al. |
| 2004/0094612 | A1 | 5/2004 | D'Amato |
| 2004/0112949 | A1 | 6/2004 | Hed et al. |
| 2004/0226948 | A1 | 11/2004 | Okushita et al. |
| 2005/0029337 | A1 | 2/2005 | Van Handel |
| 2005/0040218 | A1 | 2/2005 | Hinchey et al. |
| 2005/0045643 | A1 | 3/2005 | Ghanem |
| 2005/0115975 | A1 | 6/2005 | Smith et al. |
| 2005/0184074 | A1 | 8/2005 | Simmons et al. |
| 2005/0199697 | A1 | 9/2005 | Nugent |
| 2005/0205651 | A1 | 9/2005 | Marx |
| 2005/0236468 | A1 | 10/2005 | Sadlier |
| 2005/0258225 | A1 | 11/2005 | Martin |
| 2005/0269390 | A1 | 12/2005 | Martin |
| 2006/0038001 | A1 | 2/2006 | Stepanek |
| 2006/0118608 | A1 | 6/2006 | Stahlecker |
| 2006/0144915 | A1 | 7/2006 | Sadlier |
| 2006/0186012 | A1 | 8/2006 | D'Amato |
| 2006/0226210 | A1 | 10/2006 | Stahlecker |
| 2006/0283855 | A1 | 12/2006 | Hollis et al. |
| 2006/0289610 | A1 | 12/2006 | Kling |
| 2007/0262129 | A1 | 11/2007 | Zadravetz |
| 2007/0284426 | A1 | 12/2007 | Lo |
| 2008/0006643 | A1 | 1/2008 | Ma |
| 2008/0023536 | A1 | 1/2008 | Frost et al. |
| 2008/0023537 | A1 | 1/2008 | Frost et al. |
| 2008/0023538 | A1 | 1/2008 | Robertson et al. |
| 2008/0029588 | A1 | 2/2008 | Messerschmid et al. |
| 2008/0078825 | A1 | 4/2008 | Puls et al. |
| 2008/0087677 | A1 | 4/2008 | Robertson et al. |
| 2008/0087715 | A1 | 4/2008 | Robertson et al. |
| 2008/0087716 | A1 | 4/2008 | Sadlier |
| 2008/0093434 | A1 | 4/2008 | Van Handel |
| 2008/0105692 | A1 | 5/2008 | Hiromori |
| 2008/0105693 | A1 | 5/2008 | Hechmati |
| 2008/0121681 | A1 | 5/2008 | Wiedmeyer |
| 2008/0128433 | A1 | 6/2008 | Stauffer et al. |
| 2008/0128481 | A1 | 6/2008 | Robertson |
| 2008/0156857 | A1 | 7/2008 | Johnston |
| 2008/0169297 | A1 | 7/2008 | Kelly |
| 2008/0272118 | A1 | 11/2008 | Wang |
| 2008/0280743 | A1 | 11/2008 | Stahlecker et al. |
| 2008/0302800 | A1 | 12/2008 | Chou |
| 2008/0308620 | A1 | 12/2008 | Stepanek, Jr. |
| 2009/0020597 | A1 | 1/2009 | D'Amato |
| 2009/0121007 | A1 | 5/2009 | Van Handel |
| 2009/0159653 | A1 | 6/2009 | Stahlecker |
| 2009/0166402 | A1 | 7/2009 | D'Amato |
| 2009/0184020 | A1 | 7/2009 | Messerschmid et al. |
| 2009/0218390 | A1 | 9/2009 | Chang |
| 2009/0230178 | A1 | 9/2009 | Stahlecker et al. |
| 2009/0294520 | A1 | 12/2009 | Stepanek, Jr. |
| 2009/0321440 | A1 | 12/2009 | Fedusa et al. |
| 2009/0321508 | A1 | 12/2009 | Fu et al. |
| 2010/0025283 | A1 | 2/2010 | Oshima et al. |
| 2010/0044424 | A1 | 2/2010 | Van Handel |
| 2010/0065622 | A1 | 3/2010 | Chang |
| 2010/0072268 | A1 | 3/2010 | Johnson et al. |

FOREIGN PATENT DOCUMENTS

| | | | |
|---|---|---|---|
| CA | 844949 | | 6/1970 |
| CA | 1007182 | | 3/1977 |
| CA | 1082657 | | 7/1980 |
| CA | 1125680 | | 6/1982 |
| CA | 1125681 | | 6/1982 |
| CA | 1152011 | | 8/1983 |
| CA | 1239885 | | 8/1988 |
| CA | 1249232 | | 1/1989 |
| CA | 1257209 | | 7/1989 |
| CA | 2026197 | | 8/1991 |
| CA | 2060135 | | 7/1992 |
| CA | 2150306 | | 2/1996 |
| CA | 2043958 | | 7/1996 |
| CA | 2176080 | | 8/2001 |
| CA | 2228749 | | 10/2001 |
| CA | 2141730 | | 5/2002 |
| CA | 2197976 | | 5/2002 |
| CA | 2432791 | | 6/2002 |
| CA | 2165509 | | 7/2002 |
| CA | 2233356 | | 11/2002 |
| CA | 2431542 | | 12/2002 |
| CA | 2431869 | | 12/2002 |
| CA | 2219845 | | 4/2003 |
| CA | 2244689 | | 9/2003 |
| CA | 2271581 | | 12/2003 |
| CA | 2121491 | | 7/2004 |
| CA | 2542905 | | 1/2005 |
| CA | 2564012 | | 11/2005 |
| CA | 114070 | | 2/2006 |
| CA | 2520024 | | 3/2006 |
| CA | 2262802 | | 6/2006 |
| CA | 2549450 | | 12/2006 |
| CA | 2608826 | | 12/2006 |
| CA | 2262458 | | 1/2007 |
| CA | 2613109 | | 1/2007 |
| CA | 2621453 | | 3/2007 |
| CA | 113773 | | 4/2007 |
| CA | 119089 | | 5/2007 |
| CA | 119090 | | 5/2007 |
| CA | 119091 | | 5/2007 |
| CA | 119092 | | 5/2007 |
| CA | 2629190 | | 5/2007 |
| CA | 118452 | | 7/2007 |
| CA | 113355 | | 9/2007 |
| CA | 115931 | | 10/2007 |
| CA | 116240 | | 10/2007 |
| CA | 116241 | | 10/2007 |
| CA | 116438 | | 10/2007 |
| CA | 119239 | | 10/2007 |
| CA | 120446 | | 10/2007 |
| CA | 2545497 | | 11/2007 |
| CA | 2588413 | | 11/2007 |
| CA | 116480 | | 2/2008 |
| CA | 2598153 | | 2/2008 |
| CA | 120610 | | 3/2008 |
| CA | 2520677 | | 4/2008 |
| CA | 2664625 | | 4/2008 |
| CA | 2665633 | | 4/2008 |
| CA | 114549 | | 5/2008 |
| CA | 121962 | | 5/2008 |
| CA | 2610053 | | 5/2008 |
| CA | 122120 | | 6/2008 |
| CA | 122879 | | 7/2008 |
| CA | 2267361 | | 10/2008 |
| CA | 2598691 | | 5/2009 |
| CA | 2347777 | | 7/2009 |
| CA | 2311825 | | 10/2009 |
| CA | 2405786 | | 11/2009 |
| CA | 2394475 | | 1/2010 |
| CA | 128485 | | 2/2010 |
| DE | 1737771 | U | 1/1957 |
| DE | 11 91 285 | A | 4/1965 |
| DE | 2001499 | | 7/1970 |
| DE | 9203448 | U1 | 8/1992 |
| DE | 44 21 870 | A1 | 1/1996 |
| DE | 198 40 841 | A1 | 3/2000 |
| DE | 20 2005 006 072 | U1 | 9/2006 |
| EP | 1 031 514 | | 8/2000 |

| | | | |
|---|---|---|---|
| EP | 1 227 042 | | 7/2002 |
| EP | 1 227 043 | | 7/2002 |
| FR | 14 90 636 | | 6/1967 |
| FR | 2043987 | | 2/1971 |
| GB | 1 261 532 | | 1/1972 |
| GB | 2 044 076 | | 10/1980 |
| GB | 2 055 737 | | 3/1981 |
| GB | 2 061 699 | | 5/1981 |
| GB | 2 073 581 | | 10/1981 |
| GB | 2 077 177 | | 12/1981 |
| GB | 2 078 094 | | 1/1982 |
| GB | 2359295 | | 8/2001 |
| JP | 07-149338 | | 6/1995 |
| JP | 10-278931 | | 10/1998 |
| JP | 10-338277 | | 12/1998 |
| JP | 2000-203664 | | 7/2000 |
| JP | 2000-238739 | | 9/2000 |
| JP | 2001-180647 | | 7/2001 |
| WO | WO 99/11526 | | 3/1999 |
| WO | WO 99/59883 | | 11/1999 |
| WO | WO 00/17058 | | 3/2000 |
| WO | WO03001807 | A1 | 1/2003 |
| WO | WO03018407 | A2 | 3/2003 |
| WO | WO 2007/036928 | A3 | 4/2007 |
| WO | WO 2007/078446 | A2 | 7/2007 |
| WO | WO 2007/090415 | A1 | 8/2007 |
| WO | WO 2007/091068 | A2 | 8/2007 |
| WO | WO 2007/094838 | A2 | 8/2007 |
| WO | WO 2007/126783 | A1 | 11/2007 |
| WO | WO 2008/022180 | A2 | 2/2008 |
| WO | WO 2008/026161 | A2 | 3/2008 |
| WO | WO 2008/042378 | | 4/2008 |
| WO | WO 2008/042378 | A1 | 4/2008 |
| WO | WO 2008/045708 | A1 | 4/2008 |
| WO | WO 2008/045944 | A2 | 4/2008 |
| WO | WO 2008/067865 | A1 | 6/2008 |
| WO | WO 2008/107657 | A1 | 9/2008 |
| WO | WO 2008/119938 | A1 | 10/2008 |
| WO | WO 2008/123783 | A1 | 10/2008 |
| WO | WO 2008/146115 | A1 | 12/2008 |
| WO | WO 2009/021305 | A2 | 2/2009 |
| WO | WO 2009/032837 | A1 | 3/2009 |
| WO | WO 2009/034323 | A2 | 3/2009 |
| WO | WO 2009/039632 | A1 | 4/2009 |
| WO | WO 2009/059352 | A1 | 5/2009 |
| WO | WO 2009/074285 | A2 | 6/2009 |
| WO | WO 2009/082660 | A1 | 7/2009 |
| WO | WO 2009/118772 | A1 | 10/2009 |
| WO | WO 2010/008629 | A1 | 1/2010 |
| WO | WO 2010/011627 | A1 | 1/2010 |
| WO | WO 2010/019146 | A1 | 2/2010 |
| WO | WO 2010/031764 | A2 | 3/2010 |
| WO | WO 2010/034869 | A1 | 4/2010 |
| WO | WO 2010/036645 | A1 | 4/2010 |
| WO | WO 2010/067047 | A1 | 6/2010 |

OTHER PUBLICATIONS

International Search Report mailed Feb. 2, 2007 PCT/EP2006/008985.

A Mexican Office Action dated Jan. 19, 2012 which issued in corresponding Mexican Application No. MX/a/2008/003580.

* cited by examiner

CONTAINER AND BLANK FOR THE PRODUCTION THEREOF

RELATED APPLICATIONS

This application is a U.S. nationalization of PCT application No. PCT/EP2006/008983 filed on Sep. 14, 2006, and claims priority to German Patent Application No. 20 2005 014 738.9 filed on Sep. 19, 2005, the contents of which are incorporated herein by reference in their entirety.

The invention relates to a container which is used for storing and removing food, comprising a first and a second container half, which are connected together by means of a pivotable connection in the form of a pivotable line or the like in order to pivot between an open position and a closed position.

Such a container is known for example from practice for storing and removing a hamburger, a sandwich, a piece of pastry, or the like. Normally, the corresponding food is completely removed from the container and held in ones hands for consumption.

The container halves then form an upper and a lower container half, wherein the lower container half is used for putting down the container and the upper container half can be folded upwards about the corresponding pivotable connection for removing the food. That means that with the previously known container, the corresponding pivotable connection or pivotable line extends horizontally or in the direction transverse to the food situated in the container.

Such a container is well-suited for storing and removing the corresponding food, but it cannot be used as an aid for consuming the food. Moreover, in its closed state the previously known container is sufficiently stable for transporting the food, however, in its opened state it is relatively unstable; in this state, however, the food is only removed from the container.

It is the object of the invention to improve a container of the type mentioned in the beginning such that it is also suited for consuming the food and is more stable and can nevertheless be produced economically while it is simple to assemble.

This object is achieved by the features of claim 1.

Each container half of the container according to the invention comprises an upper and a lower, polygonal container wall when viewed from above, and a lateral wall which connects the walls at a distance in relation to each other. The corresponding pivotable line of the pivotable connection is embodied between ends of the lateral walls of the container halves which face each other. The other, second ends of the lateral walls are connected together in a detachable manner in the closed position of the container halves, where the pivotable axis which is associated with the pivotable line extends essentially perpendicular to the upper and lower container walls of the container halves.

This essentially results in a container having a left and a right container half which can be opened about a pivotable axis extending essentially perpendicular to the food situated in the container, so that the food projects from the right or left container half when the container halves are in the open position and can be used for holding the food during consumption. If the container halves are in the closed position, the correspondingly polygonal left and right container halves complement each other to form a container which correspondingly has a polygonal cross-section which, due to the plurality of corners and edges, comprises improved stability not only during transport of the food, but also when only one container half is being used for consuming the food.

To give the respective container half a simpler embodiment and to also be able to produce it more easily, the upper and lower container walls of each container half can be congruent to each other.

The stability of the container is improved by its corresponding polygonal design, the upper and lower container walls, respectively, of the first and second container halves complementing each other in the closed position to form a hexagonal, heptagonal or octagonal contour of the container, or a contour with even more corners.

In order not to have any gap in the container in its closed position and to completely enclose the food, the lower and/or upper container wall of one container half can comprise a shorter maximal length to a free end edge than the lower and/or upper container wall of the other container half.

In the closed position of both container halves, this permits an overlap between the longer and/or upper container walls of the one container half and the corresponding container walls of the other container half.

In order to more stably form at least one of the container halves in this context, free end edges of the upper and/or lower container wall of the corresponding container half can be connected flush with the free end edges of the lateral walls forming the pivotable line.

To support pivoting about the pivotable line, along the pivotable line a long stretched-out pivotable opening can be formed in the shape of an oblong hole.

To easily permit a detachable connection of the corresponding ends of the lateral walls in the closed position, the lateral walls can comprise a first and second end sections projecting beyond the free end edge of the upper and lower container walls at their second ends. These end sections of the lateral walls can then be detachably connected to each other by means of various techniques known per se, such as for example a detachable adhesive point, an insertion connection, a catch connection or the like.

In a simple embodiment, the end section of the lateral wall of the first container half comprises at its free end a tongue which detachably engages with an insertion slot arranged in a lateral wall of the second container half in the closed position. Naturally, a reversed arrangement of tongue and insertion slot is also possible.

To facilitate the connection between tongue and insertion slot and the shifting together of the corresponding end sections, between the end section of the second container half and the upper and lower container walls, open receiving slots can be formed in the direction towards the end section of the lateral wall of the first container half. Again, a reversed arrangement is possible. In this context, it is possible that in the closed position of the container halves, the corresponding end edges of the upper and lower container walls of the first container half are partially received in this receiving slot.

To be able to produce the corresponding polygonality of the container in a simple manner and simultaneously increase the stability of the container, the lateral wall can comprise corners of lateral folding lines connecting the upper and lower container walls.

To further increase stiffness, the lower and/or upper container wall of the corresponding container half can be formed of two or more layers, at least in portions.

The multilayer design can be realized by several layers of the same material, however, different materials can be also used for the various layers.

To produce the multilayer design in a simple manner and simultaneously permit the connection between lateral walls and container walls, the lateral wall can comprise adhesive flanges lying against inner surfaces of the upper and/or lower container wall, so that in particular the adjacent areas of the lateral wall and the container walls are stabilized by the resulting multilayer design. The arrangement of the corresponding adhesive flanges can also be performed reversely, so that adhesive flanges projecting from one of the container walls are fixed to an inner surface of the lateral wall. In this case, fixing is normally made by gluing together, but it can also be performed by melting on a foil applied to the adhesive flanges or to the lateral walls themselves.

For the adhesive flanges to be oriented corresponding to the inner surfaces of the corresponding walls, these can be connected in particular with the other lateral wall or the other container wall by means of a folding line.

As essentially half of the corresponding food is still arranged in one container half when the container halves are in the open position, and the projecting other half of the food projects for consumption, it can in this context furthermore prove to be advantageous for the first or else the second container half to comprise a tear line at least in the upper and lower container walls. This tear line is used, after the projecting portion of the food has been consumed, for further opening the corresponding container half, so that the rest of the food too can be further consumed out of the corresponding container half. In principle, for completely consuming the food it is possible to securely hold it just by means of the corresponding container half without any further aids, such as napkins or the like, and to essentially use this container half until the food is completely consumed.

In this context, it can be furthermore an advantage if not only the upper and lower container walls can be separated by the corresponding tear line, but if the corresponding lateral wall, too, can be separated or at least pivoted open more easily about a corresponding line. This can be achieved by the lateral wall of the corresponding container half comprising a lateral tear line connecting the tear line of the upper and lower container walls. However, this lateral tear line can also only be used, as illustrated above, as pivotable line and does not have to be actually used for completely removing the corresponding lateral wall portion.

It showed that a deformation of the corresponding container walls or lateral walls results from heat and vapor of the food situated in the container, if these walls are, for example, already bent. To avoid this, the upper and/or lower container walls and lateral wall sections arranged between adjacent folding lines can extend in a plane.

As the container essentially is a disposable packing, it is naturally advantageous if the corresponding material can be easily recycled. Such a material for the container is, for example, paper, cardboard, or the like.

To possibly additionally stiffen the connection between the container walls, as an alternative or complement to the adhesive flanges of the corresponding lateral wall, the upper and/or lower container wall can comprise adhesive flaps lying against the inner surface, in particular of the end section of the lateral wall, the flaps being connected to the rest of the container wall by means of a folding line.

To determine an in particular maximal open position of the container such that the corresponding container halves are not pivoted too far in relation to each other and these are instead, for example, essentially arranged next to each other in the open position, in the maximal open position of the container, the lateral wall sections of the lateral walls of the first and second container halves connected by means of the pivotable line can essentially lie against each other with their outer surfaces. Due to the fact that the container halves do not pivot open too far but only pivot open to such an extent that they face the consumer with their corresponding openings, for example crumbs or other food leftovers which are already arranged in the container half not being used for consuming the food or are gathered in the same, can be prevented from falling out.

The abutment of the corresponding outer surfaces is improved if their surfaces are essentially equal.

The production and assembly of the container can furthermore be improved by producing it from a single-pieced blank.

There moreover is the possibility for the container to comprise an in particular fluid-tight coating on its inner and/or outer surface. A coating on the outer surface of the container can also serve to improve the appearance of this outer surface or to more easily provide it with a print.

There also is the possibility of designing the corresponding container walls of container halves or the lateral wall such that the same comprise a certain heat-insulating effect by an air gap being for example present between the layers in case of multilayer walls, or heat transmission through the walls being reduced in any other way.

The invention also relates to a corresponding single-pieced blank for producing such a container, wherein such a blank comprises at least one longitudinal lateral wall strip for forming the lateral walls and upper and lower container wall sections projecting from this lateral wall strip along the longitudinal sides thereof. Between the longitudinal sides and in particular perpendicular to the same, a row of lateral folding lines are embodied in the lateral wall strip, and approximately centrically in the lateral wall strip, a pivotable line extending in parallel to the lateral folding lines is embodied.

To produce the corresponding adhesive flanges in this context in a simple manner, these can be arranged along the longitudinal sides of the lateral wall strip as essentially triangular adhesive flanges, between these and the container wall sections, a cutting line being embodied. In this manner, the adhesive flanges are also part of the blank and, after the corresponding assembly of the container, they only have to be glued to the inner surface of the corresponding container wall.

To facilitate the assembly in this context, the adhesive flanges can be connected to the lateral wall strips by a corresponding folding line.

To be able to produce the corresponding lateral walls of both container halves in a simple manner, the lateral wall strip can comprise two groups of lateral wall sections which are separated by two pivotable lateral wall sections, wherein the free ends of the lateral wall strip are formed by closing lateral wall sections.

For detachably fixing the corresponding closing lateral wall sections when the container is assembled, a closing lateral wall section can comprise a tongue projecting at its free end which can be inserted into a corresponding insertion opening in the lateral wall for defining a closed position of the container.

To later facilitate the corresponding pivoting of the container halves, an oblong hole extending along the corresponding pivotable line can be embodied between the two pivotable lateral sections.

Adhesive flaps cannot only be arranged in the area of the corresponding lateral wall sections, but the pivotable lateral section can also comprise approximately triangular adhesive flaps at its longitudinal sides.

To facilitate the insertion of the above mentioned tongue, an oblong hole can be formed along the corresponding lateral folding line between the closing lateral wall section and the following lateral wall section. This oblong hole is then used for inserting the tongue.

To facilitate the insertion of the tongue and more securely determine the closed position, the corresponding lateral folding line can comprise cutting sections at both ends of the oblong hole. These facilitate the insertion of the tongue which is longer than the oblong hole, its length essentially corresponding to the length of the oblong hole and the additional length of the corresponding cutting sections.

To facilitate the assembly of the container, in particular the gluing of the corresponding adhesive flanges, it is possible for an inclination of triangle sides of corresponding adhesive flanges to be essentially equal. Thereby, these triangle sides can be used for determining the corresponding folding position of lateral wall sections or else container wall sections, and in this determined position gluing is then performed.

According to the invention, by the corresponding container and blank, the stiffness of the container is increased and corresponding deformation when the food is being put into the container, transported or consumed is avoided. This is in particular achieved by the plurality of corners and folding lines and the use of double-walls or multilayered walls at least in portions.

By the use of essentially plane or flat walls, moreover deformation of the paper due to heat or vapor is largely avoided. The container can be used for consuming the food without contacting it with the hands of the consumer, so that further aids, such as for example a napkin or the like, are not necessary for consumption. The use of the tear lines permits the consumption of the complete food, so that the extent of hygiene is high until the food is completely consumed.

The corresponding container halves moreover prevent crumbs, liquid components of the food or else other parts of the food from exiting from the container, where in particular the container half not used for consumption can be used for gathering such parts. Furthermore, the corresponding overlap of the walls and the detachable closing of the container halves ensure that the food can be transported securely also during transport without opening the container.

In the following, an advantageous embodiment of the invention is illustrated more in detail with reference to the figures enclosed in the drawing.

Figure 1:
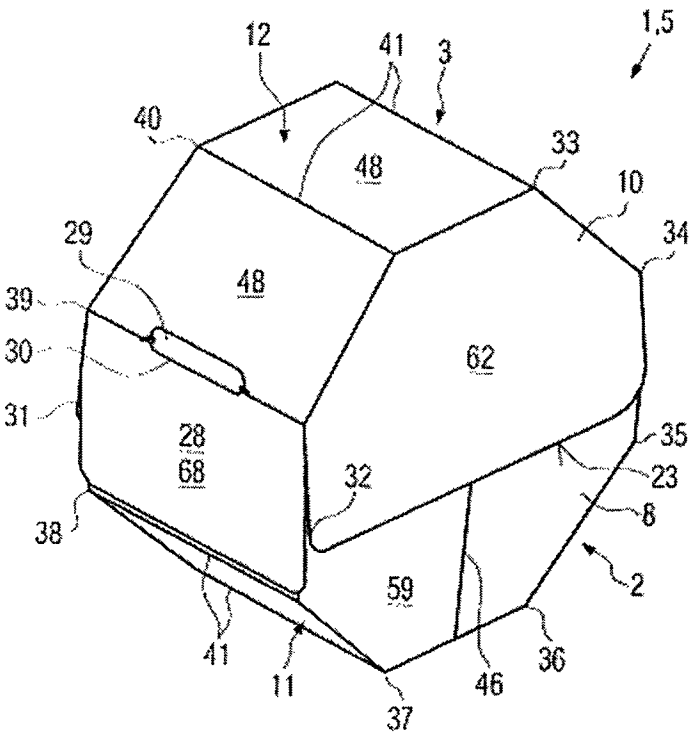
FIG. 1 shows a perspective view of a container according to the invention in a closed position.

FIG. 1 shows a perspective view of an embodiment of a container 1 according to the invention in a closed position 5. The container 1 comprises a first container half 2 and a second container half 3 which are detachably connected to each other by means of an engagement of a tongue 29 into a corresponding insertion slot 30. The first container half 2 is polygonal with corners 35, 36, 37 and 38 corresponding to the second container half 3 with corners 33, 34, 39 and 40, wherein both container halves 2, 3 complement each other to form an essentially regular octangle.

Figure 2:
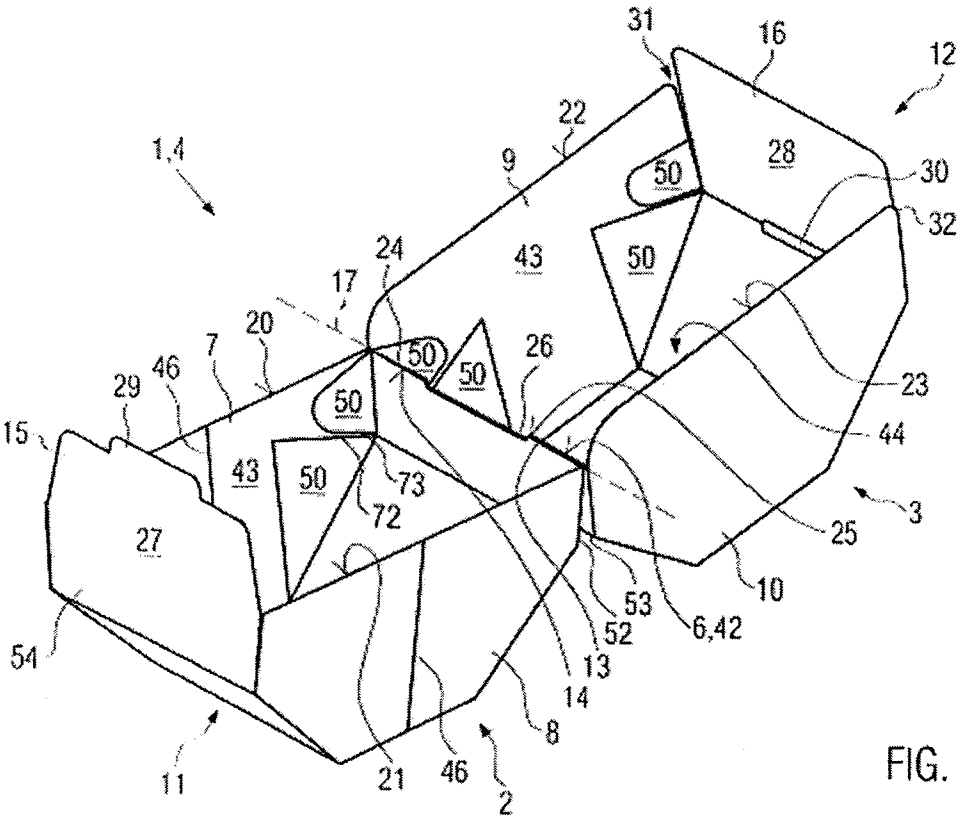
FIG. 2 shows the container according to FIG. 1 in the open position.
Figure 3:
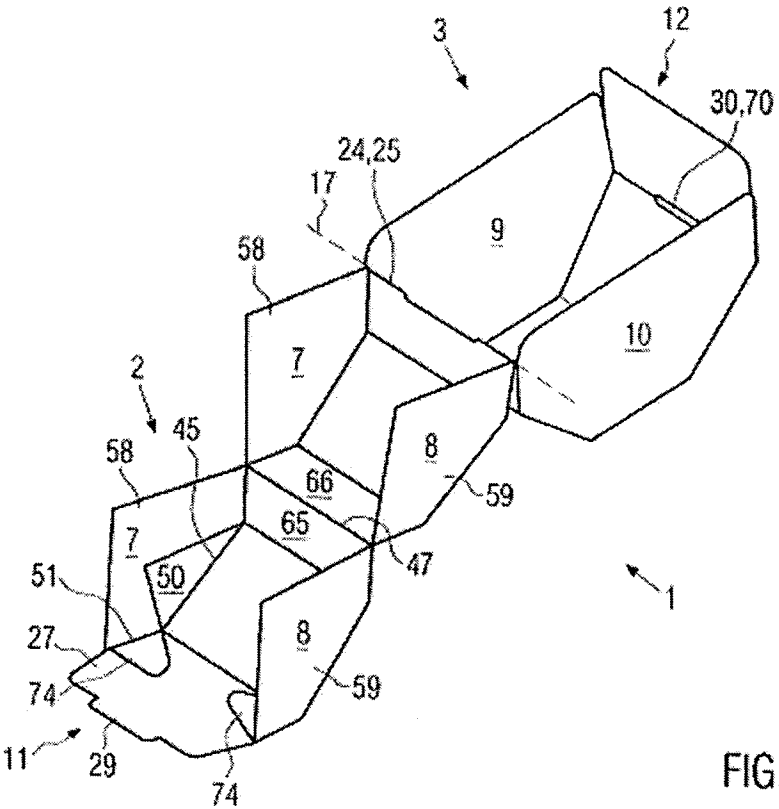
FIG. 3 shows the container according to FIG. 2 in the open position with partially torn open first container half.

The first container half 2 comprises an upper and a lower container wall 7, 8, also see FIGS. 2 and 3, which are arranged at a distance to a lateral wall 11 between the same. Analogously, the second container half 3 is assembled from an upper and a lower container wall 9, 10 and a lateral wall 12, the corresponding container walls 7, 8 and 9, 10 and the lateral wall sections 48 of the lateral walls 11, 12 arranged between corresponding lateral folding lines 41 have a plane design.

In the closed position 5 according to FIG. 1, the upper and lower container walls 9, 10, see in particular "10" in FIG. 1, partially cover the upper and lower container walls 7, 8 of the first container half 2, wherein a corresponding end section 28 of the lateral wall 12 of the second container half 3 also covers the corresponding end section 27, see FIG. 2, of the lateral wall 11 of the first container half 2.

Between the end section 28 of the lateral wall 12 and the upper and lower container walls 9, 10, open receiving slots 31, 32 are embodied in the direction towards the first container half 2. These facilitate the arrangement of the corresponding end section 27 and also of the upper and lower container walls 7, 8 of the first container half 2 in the second container half 3, also see FIG. 2.

Figure 4:
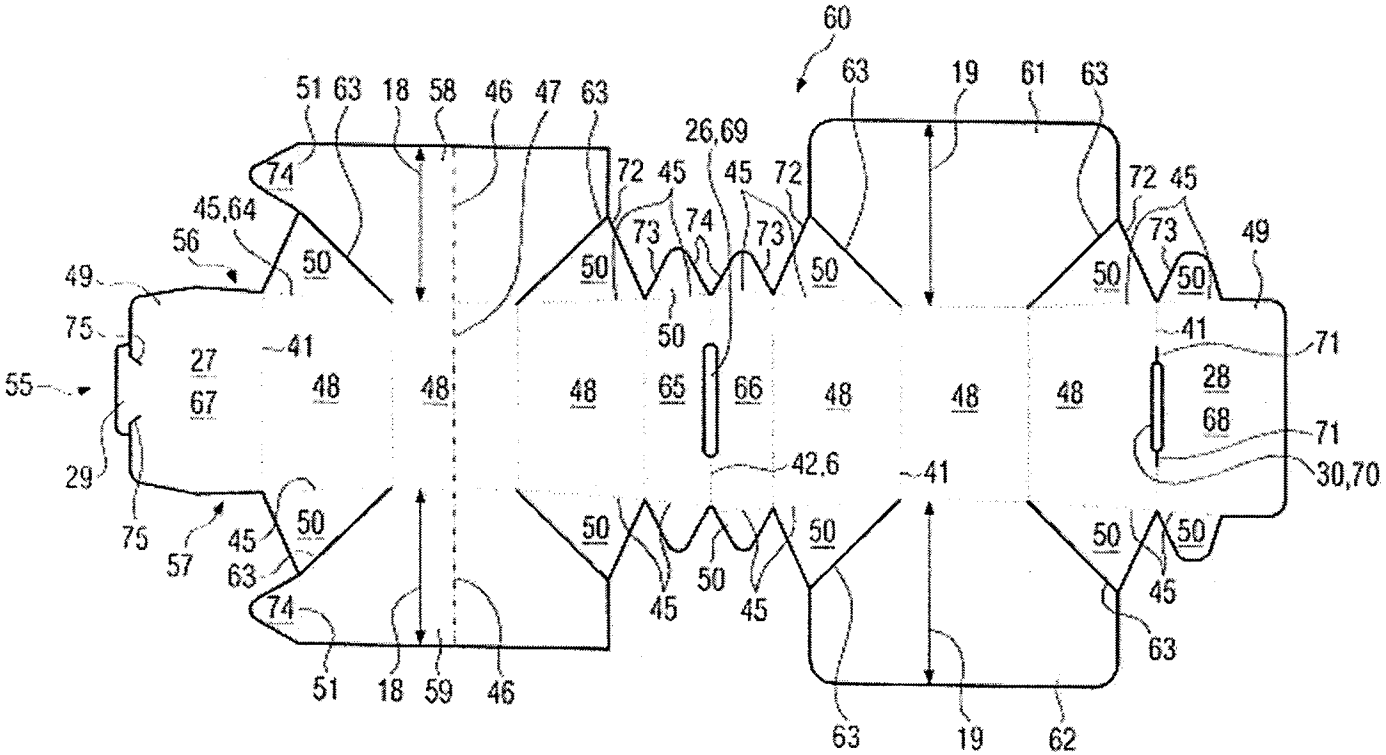
FIG. 4 shows a plan view of a single-pieced blank for producing the container according to the preceding figures.

The corresponding walls or wall sections according to FIG. 1 correspond to the corresponding lateral wall sections 48, container wall sections 58, 59 as well as 61, 62, and closing lateral wall sections 67, 68 according to FIG. 4, wherein the corresponding container halves 2, 3 can be pivoted from the closed position 5 according to FIG. 1 to an open position 4 according to FIG. 2 in relation to each other about a pivotable axis 17 defined as pivotable connection by a pivotable line 6 between the closed position and open positions.

This corresponding pivotable line is, also see for example FIG. 4, determined by a lateral folding line 42 between the pivotable lateral wall sections 65 and 66.

In FIG. 1, the corresponding tongue 29, also see FIGS. 2 to 4, is inserted into the insertion slot 30 embodied as oblong hole 70.

In FIG. 2, the container 1 is represented in its open position 4, in which the two container halves 2, 3 are arranged such that they face a consumer with their inner surfaces or the interior determined by them to remove and in particular consume food arranged in the container 1.

The first container half 2 comprises an end edge 24 at a first end 13 of its lateral wall 11 which is connected by means of the corresponding pivotable line 6 or lateral folding line 42 with the corresponding end edge 25 at the first end 14 of the lateral wall 12 of the second container half 3. A portion of the pivotable line 6 is the pivotable opening 26 embodied as oblong hole.

The lateral walls 11, 12 comprise, adjacent to the first end 13 or 14, respectively, outer surfaces 52 and 53 which determine a maximal open position in which the two outer surfaces 52, 53 lie against each other. These outer surfaces essentially have the same area.

The lateral walls 11, 12 comprise the same number of lateral wall sections 48 and essentially differ in corresponding end sections 27, 28 used for detachably closing the container 1, also see FIG. 1. These end sections 27, 28 each comprise second ends 15, 16 of the lateral walls 11, 12. Here, the tongue 29 is embodied at the second end 15 of the end section 27. It is inserted into the corresponding insertion slot 30, also see FIG. 1, for defining and assuming the closed position 5.

Free end edges 20 and 21 of the upper and lower container walls 7, 8 of the first container half 2 pass over flush into the first end edges 24, 25 at the first end 13, 14 of the lateral walls 11, 12. The corresponding free end edges 22, 23 of the upper and lower container walls 9, 10 of the second container half 3 then project over these end edges 24, 25, also see FIG. 4. This projection serves for receiving the corresponding ends of the upper and lower container walls 7, 8, in the closed position, see FIG. 1.

Adhesive flanges 50 are fixed on the inner surfaces 43, 44 of the corresponding container walls and connected by means of corresponding folding lines 45 to the laterals walls 11, 12. The corresponding adhesive flanges are essentially triangular, wherein in FIG. 2 triangle sides 72, 73 of the corresponding adhesive flanges facing each other essentially lie against each other. Thereby, during the production of the container 1 from a single-pieced blank 60 according to FIG. 4, the corresponding folding state of the lateral wall sections in relation to each other are essentially determined.

In the upper and lower container walls 7, 8 of the first container half 2, tear lines 46 are centrically embodied, for example by a perforation. These are used for tearing open the corresponding container walls 7, 8, also see FIG. 3, to improve accessibility to the remaining food after it has been partially consumed.

In FIG. 2, in particular the receiving slots 31, 32 can be also easily seen which improve elasticity of the corresponding end section 28 for facilitated closing of the container. Moreover, these receiving slots 31, 32 can also be used for receiving corresponding end edges 20, 21 of the upper and lower container walls 7, 8, when the end section 27 is arranged externally on the end section 28, when the tongue 29 is inserted in the insertion slot 30.

In FIG. 2, one can in particular also see that a corresponding maximal length 18, 19, also see FIG. 4, of the upper and lower container walls 7, 8 or of the upper and lower container walls 9, 10, respectively, is different, so that the upper and lower container walls 9, 10 of the second container half 3 in the represented embodiment grip over the upper and lower container walls 7, 8 of the first container half 2, also see FIG. 1, from outside, so that the corresponding free end edges 20, 21 of the upper and lower container walls 7, 8 are inserted in the second container half 3.

By the arrangement of the corresponding adhesive flanges 50 on the inner surfaces 43 of the container walls 7 to 10, a double-layer design results in particular in this area which increases stiffness of the container, besides the increase of stiffness by the number of folding lines and corners of the container.

At this point, it should be briefly noted that in all figures the same parts are provided with the same reference numerals, and some of these reference numerals are only given in one figure and are only described in connection with one figure.

In FIG. 3, the container 1 is represented with the outer surface 54 of FIG. 2 in a tear-open position of the upper and lower container walls 7, 8 of the first container half 2. This position differs in particular from the corresponding open position according to FIG. 2 in that the container walls 7, 8 are torn open along the corresponding tear lines 46, also see FIGS. 1 and 2. One can moreover see that in the corresponding lateral wall 11 of the first container half 1, a lateral tear line 47 connecting the tear lines 46 in the upper and lower container walls 7, 8 is formed. This makes it possible to completely separate the portion of the first container half 2 comprising the tongue 29. However, the corresponding lateral tear line 47 can also be essentially employed as pivotable line to open the first container half 2 to the corresponding tear position according to FIG. 3.

In FIG. 3, in particular another adhesive flange 50 adjacent to the end section 27 can be seen which is glued to the corresponding inner surface 43 of the upper container wall 7 and correspondingly to the lower container wall 8. This adhesive flange is connected to the lateral wall 11 by means of the folding line 45. Another adhesive flange 74 extends from the upper or lower container wall 7, 8, respectively, towards the end section 27 and is glued to the same on its inner surface. The adhesive flange 74, too, is connected to the upper or lower container wall 7, 8, respectively, by means of a corresponding folding line 51, also see FIG. 4.

In FIG. 4, a plan view of a single-pieced blank for producing the container according to FIGS. 1 to 3 is represented.

Here, too, corresponding same parts of the previous figures are provided with the same reference numerals.

The blank 60 in particular comprises a lateral wall strip 55 comprising a plurality of lateral wall sections which are correspondingly separated from each other by lateral folding lines 41, 42. The various sections in particular also comprise pivotable lateral wall sections 65, 66 which are arranged approximately centrically in the lateral wall strip 55 and between which the folding line 42 determines the corresponding pivotable line 6 or pivotable axis 17. The oblong hole 69 is embodied as pivotable opening 26 in the corresponding folding line 42. Furthermore, the wall sections comprise the closing lateral wall sections 67 and 68 which correspondingly form the end sections 27 and 28 of the container, also see FIG. 2. Container wall sections 58, 59 and 61, 62 project along longitudinal sides 56, 57 of the lateral wall strip 55. The container wall sections 58, 59 form upper and lower container walls 7, 8, and the container wall sections 61, 62 form upper and lower container walls 9, 10 of the corresponding first or second container half 2, 3, respectively, see again FIG. 2.

A further part of the single-pieced blank 60 according to FIG. 4 are the essentially triangular adhesive flaps 50 or 74, wherein the adhesive flaps 50 each are connected by means of corresponding folding lines 45 or 64, respectively, to the lateral wall strip 55, and the further adhesive flaps 74 are connected by means of lateral folding line 51 to the upper and lower container walls 7, 8 of the first container half 2.

One can see in FIG. 2 how the corresponding adhesive flaps 50 are placed against inner surfaces 43, 44 of the container walls 7 to 10 and fixed there by gluing, wherein in FIG. 3 the same is also represented for the adhesive flaps 74 on the corresponding inner surface of the end section 27.

To permit the corresponding pivoting of the adhesive flaps during the production of the container independent of the folding of the corresponding container walls 7 to 10, cutting lines 63 are arranged along a triangle side of the corresponding adhesive flaps which separate the adhesive flaps from the container walls 7 to 10 in this area.

Apart from these cutting lines 63 as one triangle side, the corresponding triangles comprise further triangle sides 72 and 73 which are used for defining a corresponding folding state of the lateral wall sections as well as of the container walls in that they abut against each other, see FIG. 2.

One can see furthermore in FIG. 4 that the corresponding lateral tear line 47 connects the tear lines 46 in the upper container wall 7 or in the corresponding container wall section 58 with the tear line 46 in the lower container wall 8 or the container wall section 59. This tear line is at least used for opening the container 1 in the manner shown in FIG. 3, wherein in this connection the lateral tear line 47 serves as pivotable line.

From each of the pivotable lateral wall sections 65, 66, along the corresponding longitudinal sides 56, 57 of the lateral wall strip 55, corresponding adhesive flaps 50 project in pairs which are situated oppositely, also see FIG. 2.

In the area of the oblong hole 70 forming the insertion slot 30, cutting sections 71 are embodied along the corresponding lateral folding line 41 which support the insertion of the tongue 29 with cutting lines 75 into the insertion slot 30 and in particular the detachable holding of the tongue in the slot.

The container and the single-pieced blank, respectively, according to the invention altogether result in a container shape which permits a kind of opening the container by pivoting different to that of previously known containers, wherein according to the invention one of the container halves is used for holding food situated in the container, such as a hamburger, a sandwich or the like. In this context it should also be noted that the corresponding tear lines 46 in the representation according to FIG. 2 can be used for better holding the food, wherein the corresponding container walls 7, 8 can be more easily pressed inwards towards the food in the area of the tear line 47, wherein the corresponding tear lines are essentially used as creasing lines for the container walls 7, 8. Only when half of the food is then essentially consumed, the tear lines 46 can be torn to further open the container, see FIG. 3. This position according to FIG. 3 is then essentially used until the food is completely consumed, wherein the corresponding parts of the first container half 2 can be repeatedly pivoted towards each other about the lateral tear line 47 to handle the remaining food and change its position between the upper and lower container walls 7, 8.

According to the invention, therefore no further aid for the consumption or for keeping the consumer clean is necessary, and even parts falling away from the food, such as crumbs, sauces or other food components, are securely received by the corresponding container halves.

The invention claimed is:

1. Container for storing and removing food, comprising a first and a second container half, which are connected together by means of a pivotable connection in order to pivot between an open position and a closed position, each container half comprising an upper and lower, polygonal, container wall when viewed from above, and each container half further comprising a lateral wall which connects the corresponding upper and lower container walls at a distance in relation to each other, the pivotable connection being formed by a pivotable line embodied between facing first ends of the lateral walls, and second ends of the lateral walls are detachably connected to each other in the closed position, wherein the pivotable connection formed by the pivotable line extends essentially perpendicular to the upper and lower container walls, the first container half comprising one and only one central tear line in each of the upper and lower container walls of the first container half, the first container half further comprising a lateral tear line extending between the respective central tear lines in each of the upper and lower container walls of the first container half, and each of the upper and lower container walls of the first container half has a free end edge that is continuously linear from a first end proximate the pivotable line to a second end at the lateral wall connecting the upper container wall and the lower container wall of the first container half.

2. Container according to claim 1, wherein the upper and lower container walls are congruent to each other.

3. Container according to claim 2, wherein the upper or lower container wall of the first and second container halves complement each other in the closed position to form a hexagonal, heptagonal, octagonal or polygonal contour.

4. Container according to claim 3, wherein the lower or upper container wall of the first container half comprises a shorter maximal length to the free end edge than a corresponding length on the lower and/or upper container wall of the second container half.

5. Container according to claim 4, wherein the free end edge of the upper container wall of the first container half is flush with the free end edge of the lateral wall that connects the upper and lower container walls of the first container half at the pivotable line, or a free end edge of the lower container wall of the first container half is flush with free end edge of the lateral wall that connects the upper and lower container walls of the first container half at the pivotable line.

6. Container according to claim 5, wherein along the pivotable line a long-stretched out opening is embodied in the form of an oblong hole.

7. Container according to claim 6, wherein the lateral walls comprise at their second ends each a first and second end section projecting beyond the free end edge of the upper and lower container walls.

8. Container according to claim 7, wherein the end section of the lateral wall of the first container half comprises a tongue at its end which detachably engages with an insertion slot arranged in the lateral wall of the second container half in the closed position.

9. Container according to claim 8, wherein between the end section of the second container half and the upper and lower container walls open receiving slots are formed in the direction towards the end section of the lateral wall of the first container half.

10. Container according to claim 9, wherein the lateral wall comprises corners of lateral folding lines connecting the upper and lower container walls.

11. Container according to claim 10, wherein at least the lower and/or upper container wall has two or more layers at least in portions.

12. Container according to claim 11, wherein the lateral wall comprises adhesive flanges lying against an inner surface of the upper and/or lower container walls.

13. Container according to claim 12, wherein the adhesive flanges are connected to the rest of the lateral wall by means of a folding line.

14. Container according to claim 1, wherein the lateral tear line is employed as pivotable line.

15. Container according to claim 14, wherein the upper or lower container wall and lateral wall sections of the lateral wall arranged between adjacent lateral folding lines extend in a plane.

16. Container according to claim 15, wherein the material of the container is paper, cardboard or the like.

17. Container according to claim 16, wherein the upper and/or lower container wall comprises adhesive flanges lying against an inner surface at the end section of the lateral wall which are connected to the rest of the container wall by means of a folding line.

18. Container according to claim 17, wherein in the maximal open position of the container, the lateral wall sections of the lateral walls of the first and second container halves connected by means of the pivotable line lie against their outer surfaces.

19. Container according to claim 18, wherein the area of the outer surfaces is essentially the same.

20. Container according to claim 19, wherein the container is made of a single-pieced blank.

21. Container according to claim 20, wherein the container comprises a fluid-tight coating on its inner and/or outer surface.

22. Single-pieced blank for producing a container according to claim 21, which comprises:

at least one lateral wall strip for forming the lateral walls; and upper and lower polygonal container wall sections projecting from this lateral wall strip along its longitudinal sides, wherein between the longitudinal sides and perpendicular to these, a number of lateral folding lines are embodied in the lateral wall strip, and approximately centrically in the lateral wall strip, a pivotable line extending in parallel to the lateral folding lines is embodied.

23. Blank according to claim 22, wherein essentially triangular adhesive flaps are arranged along the longitudinal sides of the lateral wall strip, between these and the container wall sections a cutting line being formed.

24. Blank according to claim 23, wherein the adhesive flanges are connected to the lateral wall strip by means of a folding line.

25. Blank according to claim 24, wherein the lateral wall strip comprises two groups of lateral wall sections which are separated from each other by two pivotable lateral wall sections, wherein closing lateral wall sections are arranged at free ends of the lateral wall strip.

26. Blank according to claim 25, wherein one closing lateral wall section comprises a tongue projecting at its free end.

27. Blank according to claim 26, wherein between the two pivotable lateral wall sections an oblong hole extending along the pivotable line is embodied.

28. Blank according to claim 27, wherein the pivotable lateral wall section comprises at its longitudinal side approximately triangular adhesive flaps.

29. Blank according to claim 28, wherein between the closing lateral wall section and the subsequent lateral wall section, an oblong hole is embodied along the corresponding lateral folding line.

30. Blank according to claim 29, wherein at both ends of the oblong hole, the lateral folding line comprises cutting sections.

31. Blank according to claim 30, wherein an inclination of triangle sides of the adhesive flaps facing each other in a container produced from the blank is essentially the same.

32. A container for storing and removing food, comprising a first and a second container half, which are connected together by means of a pivotable connection in order to pivot between an open position and a closed position, wherein each container half comprises an upper and lower, polygonal, container wall when viewed from above, and a lateral wall which connects the walls at a distance in relation to each other, wherein the pivotable connection is formed by a pivotable line embodied between facing first ends of the lateral walls, and the second ends of the lateral walls are detachably connected to each other in the closed position, wherein the pivotable axis associated to the pivotable line extends essentially perpendicular to the upper and lower container walls, wherein the first container half comprises a tear line in each of the upper and lower container walls, wherein the first container half comprises a lateral tear line extending between the respective tear lines in each of the upper and lower container walls, and wherein the lateral wall comprises adhesive flanges lying against an inner surface of the upper and/or lower container walls.

33. The container according to claim 32, wherein the adhesive flanges are connected to the rest of the lateral wall by means of a folding line.

34. Container for storing and removing food, comprising a first and a second container half, which are connected together by means of a pivotable connection in order to pivot between an open position and a closed position, wherein each container half comprises an upper and lower, polygonal, container wall when viewed from above, and each container half further comprises a lateral wall which connects the corresponding upper and lower container walls at a distance in relation to each other, wherein the pivotable connection is formed by a pivotable line embodied between facing first ends of the lateral walls, and second ends of the lateral walls are detachably connected to each other in the closed position, wherein the pivotable connection formed by the pivotable line extends essentially perpendicular to the upper and lower container walls, wherein the first container half comprises a central tear line that extends through a bisecting midline of each of the upper and lower container walls of the first container half, wherein the first container half comprises a lateral tear line extending between the respective central tear lines in each of the upper and lower container walls of the first container half.

* * * * *